US009752401B2

(12) United States Patent
Hallundbæk et al.

(10) Patent No.: US 9,752,401 B2
(45) Date of Patent: Sep. 5, 2017

(54) SETTING TOOL

(71) Applicant: WELLTEC A/S, Allerød (DK)

(72) Inventors: Jørgen Hallundbæk, Græsted (DK); Rasmus Sommer, Valby (DK)

(73) Assignee: Welltec A/S, Allerød (DK)

( * ) Notice: Subject to any disclaimer, the term of this patent is extended or adjusted under 35 U.S.C. 154(b) by 278 days.

(21) Appl. No.: 14/363,082

(22) PCT Filed: Dec. 20, 2012

(86) PCT No.: PCT/EP2012/076283

§ 371 (c)(1),
(2) Date: Jun. 5, 2014

(87) PCT Pub. No.: WO2013/092799

PCT Pub. Date: Jun. 27, 2013

(65) Prior Publication Data

US 2014/0332234 A1 Nov. 13, 2014

(30) Foreign Application Priority Data

Dec. 21, 2011 (EP) ..... 11195035

(51) Int. Cl.
*E21B 23/04* (2006.01)
*E21B 23/02* (2006.01)
*E21B 17/06* (2006.01)

(52) U.S. Cl.
CPC ..... *E21B 23/04* (2013.01); *E21B 17/06* (2013.01); *E21B 23/02* (2013.01)

(58) Field of Classification Search
CPC ..... E21B 17/06
See application file for complete search history.

(56) References Cited

U.S. PATENT DOCUMENTS 1,470,114 A 10/1923 Erwin
3,071,188 A 1/1963 Raulins
(Continued)

FOREIGN PATENT DOCUMENTS

CN 201184138 Y 1/2009
EA 200600858 A1 12/2006
(Continued)

OTHER PUBLICATIONS

International Search Report for PCT/EP2012/076283 mailed Feb. 13, 2013.
(Continued)

*Primary Examiner* — Giovanna C Wright
*Assistant Examiner* — Manuel C Portocarrero
(74) *Attorney, Agent, or Firm* — Nixon & Vanderhye P.C.

(57) ABSTRACT

The present invention relates to a release device (10) for releasably connecting a downhole object (80), such as a running tool or a plug, to a setting tool, the release device extending between a proximal end (10*a*) adapted to be coupled to the setting tool and a distal end (10*b*) adapted to be coupled to the downhole object, the release device comprising a base element (16) extending in a longitudinal direction and a connecting element arranged in continuation of the base element, the connecting element (11) constituting the distal end of the release device and being adapted to be coupled to the downhole object, wherein the connecting element is releasably coupled to the base element by an activatable release mechanism (60). Further, the invention relates to a downhole setting tool for setting an object in a wellbore and to a method for disconnecting a downhole object.

17 Claims, 7 Drawing Sheets

(56) References Cited

U.S. PATENT DOCUMENTS

| | | | | |
|---|---|---|---|---|
| 3,452,815 | A | 7/1969 | Watkins | |
| 3,737,181 | A | 6/1973 | Low et al. | |
| 4,523,643 | A | 6/1985 | McGlothen | |
| 4,554,981 | A | 11/1985 | Davies | |
| 4,694,878 | A | 9/1987 | Gambertoglio | |
| 5,217,077 | A | 6/1993 | Hart | |
| 5,718,291 | A * | 2/1998 | Lorgen | E21B 17/06 166/377 |
| 6,923,256 | B2 | 8/2005 | Parker | |
| 2004/0134667 | A1 | 7/2004 | Brewer et al. | |
| 2004/0216887 | A1 | 11/2004 | Bertelsen | |
| 2005/0000693 | A1 | 1/2005 | Ravensbergen et al. | |
| 2009/0272544 | A1* | 11/2009 | Giroux | E21B 47/122 166/382 |
| 2010/0263856 | A1* | 10/2010 | Lynde | E21B 23/14 166/53 |

FOREIGN PATENT DOCUMENTS

| | | | |
|---|---|---|---|
| EP | 0 624 709 | A2 | 11/1994 |
| RU | 2 101 458 | C1 | 1/1998 |
| RU | 2 444 607 | C1 | 3/2012 |
| SU | 1477895 | A1 | 5/1989 |

OTHER PUBLICATIONS

International Preliminary Report on Patentability dated Feb. 26, 2014.

English translation of Decision on Patent Grant for Invention mailed Nov. 25, 2016 in Russian Application No. 2014126725/03(043328), 12 pages.

* cited by examiner

SETTING TOOL

This application is the U.S. national phase of International Application No. PCT/EP2012/076283 filed 20 Dec. 2012 which designated the U.S. and claims priority to EP 11195035.8 filed 21 Dec. 2011, the entire contents of each of which are hereby incorporated by reference.

FIELD OF THE INVENTION

The present invention relates to a release device for releasably connecting a downhole object, such as a running tool or a plug, to a setting tool. Further, the invention relates to a downhole setting tool for setting an object in a wellbore and to a method for disconnecting a downhole object.

BACKGROUND ART

Setting tools are used for setting, i.e. anchoring, plugs or other objects downhole. To set a plug, a setting tool may be connected to a running tool coupled to the plug to be set. When the plug has been positioned in the desired position downhole, an axial force is applied via the running tool to the plug, whereby the plug is set downhole and the running tool and/or the setting tool are/is released from the plug.

However, if the setting process fails, e.g. due to malfunction of the mechanical system of the plug or setting tool, the plug may not be appropriately set, whereby the setting tool is not released from the plug. In case of connection to a partly set plug, it may be very difficult, or simply impossible, to extract the setting tool from the well, and then special tools are required. In order to retrieve a stuck tool, more heavy equipment having more power is necessary to pull the tool out, or if the stuck setting tool remains stuck, the tool has to be drilled out, resulting in costly production time being lost.

SUMMARY OF THE INVENTION

It is an object of the present invention to wholly or partly overcome the above disadvantages and drawbacks of the prior art. More specifically, it is an object to provide an improved setting tool that may be released from a downhole object, such as a running tool or a plug in case of a malfunction in the mechanical- and/or hydraulic system of the plug or setting tool, so that the setting tool does not get stuck downhole.

The above objects, together with numerous other objects, advantages, and features, which will become evident from the below description, are accomplished by a solution in accordance with the present invention by a release device for releasably connecting a downhole object, such as a running tool or a plug, to a setting tool, the release device extending between a proximal end adapted to be coupled to the setting tool and a distal end adapted to be coupled to the downhole object, the release device comprising:

- a base element extending in a longitudinal direction, and
- a connecting element arranged in continuation of the base element, the connecting element constituting the distal end of the release device and being adapted to be coupled to the downhole object, wherein the connecting element is releasably coupled to the base element by an activatable release mechanism.

In one embodiment, the activatable release mechanism may comprise an activatable locking sleeve slidable in the longitudinal direction and a key element having a plurality of key fingers flexible in an inwards radial direction and adapted to latch onto the connecting element, the inwards flexibility of the key fingers being controlled by the position of the locking sleeve.

In another embodiment, the release mechanism may further comprise a release spring forcing the locking sleeve and the key element in mutually opposite directions, whereby upon activation of the locking sleeve, the release spring is adapted to force the locking sleeve into a release position, thereby activating the release mechanism and allowing separation of the connecting element from the base element.

Hereby, a downhole object connected with the connecting element may be separated from the remainder of the release device by activating the release mechanism, thereby disengaging the key fingers from the connecting element.

In one embodiment, the release mechanism may be a hydraulically activated mechanical release mechanism.

Also, the activatable locking sleeve may be hydraulically activated.

In another embodiment, the activatable locking sleeve may be hydraulically activated by injection of a hydraulic fluid into an expandable space, defined, at least partly, by a piston face of the locking sleeve, whereby hydraulic fluid supplied under pressure to the expandable space will force the locking sleeve in a direction towards the distal end of the release device, thereby compressing the release spring.

Furthermore, the base element may comprise a fluid channel for supplying the hydraulic fluid to the expandable space.

Moreover, the activatable locking sleeve may be slidably arranged around at least a part of the base element, and wherein the expandable space is at least partly defined by the base element and the piston face of the locking sleeve.

Further, the base element may comprise an annular bore encircling a protruding centre part of the base element extending in the longitudinal direction, and the activatable locking sleeve may be slidably arranged around the protruding centre part and slidably arranged between a locking position, wherein the locking sleeve may prevent inwards radial movement of the key fingers, and a release position, wherein the key fingers may be inwardly flexible.

Also, the key element may encircle the activatable locking sleeve.

Moreover, part of the activatable locking sleeve may enclose part of the annular bore, thereby providing the expandable space adapted to be expanded by supply of the hydraulic fluid via the fluid channel provided in the base element, whereby the locking sleeve may be forced in the longitudinal direction towards the distal end of the release device and thereby activated, and wherein a release spring may be adapted to force the activated locking sleeve in an opposite direction into the release position when the supply of hydraulic fluid is terminated.

Hereby, a downhole object connected with the connecting element may be separated from the release device by disengaging the key fingers from the connecting element when the supply of hydraulic fluid is terminated.

In one embodiment, the base element may comprise a radial protruding pin preventing the release spring from forcing the locking sleeve in the direction away from the distal end of the release device and into the release position before the activatable locking sleeve has been activated.

In another embodiment, the pin may be a shear pin adapted to break when a hydraulic fluid is supplied to the annular chamber, and the locking sleeve may be forced in the longitudinal direction towards the distal end of the release device.

Furthermore, the locking sleeve may comprise a guide slot cooperating with the pin, whereby the locking sleeve may be rotated when the locking sleeve is forced towards the distal end of the release device by supply of a hydraulic fluid to the expandable chamber.

Said guide slot may be a j-slot.

In an embodiment, the connecting element may comprise a first recess provided in an outer surface thereof for providing a fishing neck.

In another embodiment, the connecting element may comprise a second inwards facing recess arranged internally in the connection element, thereby constituting a fishing neck.

In yet another embodiment, an end of the locking sleeve defining the expandable chamber may comprise a flange providing a piston face facing the expandable chamber.

Also, the release spring may abut the flange of the locking sleeve and an end of the key element, thereby forcing the locking sleeve and the key element in mutually opposite directions.

Further, key fingers may comprise protrusions at a distal end for engaging a recess of the connection element.

Moreover, the expandable chamber may be fluidly connected with the wellbore via an inflow control valve and the pressure in the wellbore may be used to supply hydraulic fluid to the expandable chamber.

Furthermore, the connecting element may have an outer thread adapted to be connected to a downhole object, such as a running tool or plug.

Also, the outer thread of the connecting element may be in accordance with the standard Baker E4-20 or Baker E4-10.

Moreover, the key fingers may engage a recess in the connecting element.

The invention also relates to a downhole setting tool for setting an object, such as a plug, in a wellbore, the downhole setting tool extending between a proximal end adapted to be coupled to a tool string and a distal end facing the object to be set, the downhole setting tool comprising:

a stroke cylinder defining a piston chamber, a hydraulic piston being slidably arranged in the piston chamber for providing a force in the longitudinal direction by supply of a hydraulic fluid to the piston chamber, and a first piston rod extending from the hydraulic piston, wherein the downhole setting tool may comprise a release device according to the invention for releasably connecting the piston rod with a downhole object.

Said downhole setting tool may comprise a hydraulic system comprising a pump unit driven by an electrical motor for supplying a hydraulic fluid to the piston chamber.

Also, the downhole setting tool may further comprise a hydraulic system comprising a pump unit driven by an electrical motor, and the pump unit may be adapted to supply a hydraulic fluid to the piston chamber and to the expandable space of the release device, whereby supply of the hydraulic fluid to the expandable space activates the locking sleeve.

Also, the hydraulic piston may travel up to 400 mm in the axial direction in the stroke cylinder.

In one embodiment, the stroke cylinder may comprise a second chamber and a second piston rod extending from the hydraulic piston opposite the first piston rod and into the second chamber.

Said second chamber of the stroke cylinder may have an internal pressure substantially equal to a pressure in the well, whereby the forces exerted on the first piston rod by the pressure in the well may be substantially balanced by the force exerted on the second piston rod by the pressure in the second chamber.

Hereby, the force required to move the hydraulic piston may be reduced as the force exerted on the piston rod pointing in the direction of movement of the hydraulic piston by the pressure in the well may be substantially compensated by the force exerted on the opposite piston rod by the pressure in the well.

Furthermore, the downhole setting tool may comprise a first longitudinal fluid channel provided in the wall of the stroke cylinder for supplying a hydraulic fluid to the piston chamber in order to push the hydraulic piston in a direction towards the proximal end of the downhole setting tool.

The downhole setting tool may also comprise a second longitudinal fluid channel provided in the wall of the stroke cylinder for supplying a hydraulic fluid to the piston chamber in order to push the hydraulic piston in a direction towards the distal end of the downhole setting tool.

In one embodiment, the first piston rod may comprise a fluid channel for supplying the hydraulic fluid to the release device.

Said fluid channel of the first piston rod may be in fluid communication with the piston chamber and the fluid channel of the base element, whereby hydraulic fluid may be supplied to the release device via the fluid channel of the first piston rod.

Also, the fluid channel may be a central bore extending in the longitudinal direction of the piston rod.

The downhole setting tool according to the invention may further comprise a locking element comprising a plurality of locking fingers flexible in a radial direction and adapted to latch onto the recess in the outer surface of the connecting element of the release device when the hydraulic piston is pushed all the way towards the proximal end of the downhole setting tool.

Furthermore, the locking fingers may latch onto a recess in an outer surface of the connecting element when the hydraulic piston is in the fully upstroke position.

In one embodiment, the downhole setting tool may further comprise a spacer element extending from the stroke cylinder towards the distal end of the downhole setting tool.

In another embodiment, the downhole setting tool according to the invention may comprise a driving unit for driving the entire downhole setting tool forward in a wellbore.

Finally, the present invention relates to a method for disconnecting a downhole object, such as a running tool or plug, from a downhole setting tool according to the invention, the method comprising the steps of:

supplying a hydraulic fluid to the release device, whereby the locking sleeve is forced towards the distal end of the release device while being rotated about a longitudinal axis, terminating the supply of hydraulic fluid to the release device, whereby the release spring forces the locking sleeve into a release position allowing inwards radial movement of the key fingers, and applying a pulling force to the release device by moving the hydraulic piston or pulling in the entire downhole setting tool, whereby the key fingers are forced out of engagement with the connecting element.

In one embodiment, the pulling force required to force the key fingers out of engagement with the connecting element may be 100 kg-300 kg, preferably approximately 250 kg.

Hereby, unintentional disconnection between the key element and the connecting element may be avoided.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
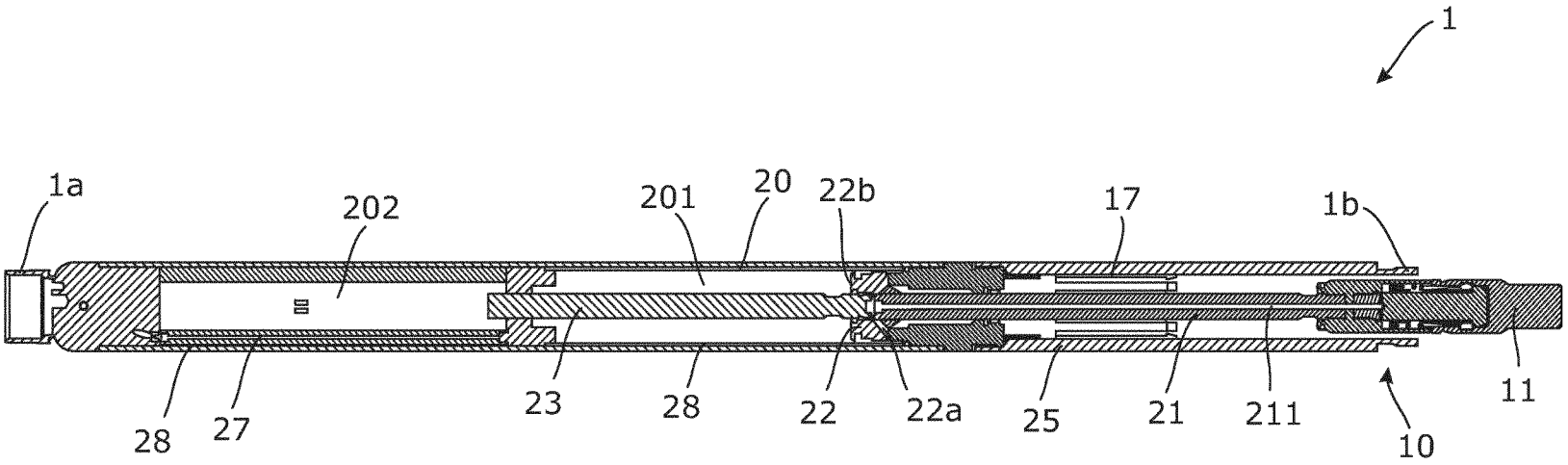
FIG. 1 shows a downhole setting tool provided with a release device.
Figure 4:
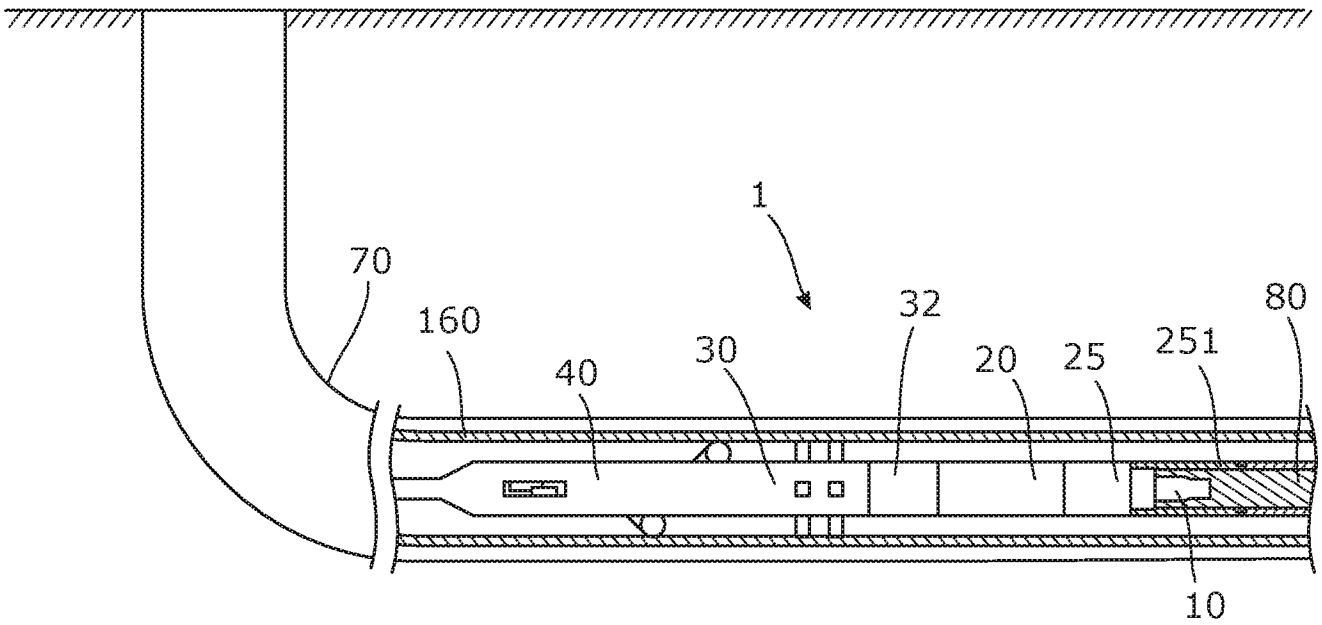
FIG. 4 shows the downhole setting tool inserted into a wellbore with an object to be set connected with the release device.

FIG. 1 shows a downhole setting tool 1 extending between a proximal end 1*a* and a distal end 1*b*. The proximal end 1*a* constitutes an interface to the remaining tool string, and the distal end 1*b* faces the object 80 to be set during use, as shown in FIG. 4. The downhole setting tool 1 comprises a stroke cylinder 20 constituting most of the longitudinal extension of the downhole setting tool 1 and a spacer element 25 extending from the stroke cylinder 20 towards the distal end 1*b* of the downhole setting tool 1. The stroke cylinder 20 defines a piston chamber 201 in which a hydraulic piston 22 is slidably arranged and movable between a downstroke position, wherein the hydraulic piston 22 is pushed all the way towards the distal end 1*b* of the downhole setting tool 1, as shown in FIG. 1, and a upstroke position, wherein the hydraulic piston 22 is pushed all the way towards the proximal end 1*a* of the downhole setting tool 1. By injecting a hydraulic fluid into the piston chamber on respective sides of the hydraulic piston, the hydraulic piston provides a force in either the upstroke direction towards the upstroke position or in the downstroke direction towards the downstroke position. When the hydraulic piston moves in the upstroke direction, hydraulic fluid is pumped from the proximal side of the hydraulic piston to the distal side of the hydraulic piston by a pumping unit 32, as shown in FIG. 4. On the other hand, when the hydraulic piston moves in the downstroke direction, hydraulic fluid is pumped from the distal side of the hydraulic piston to the proximal side of the hydraulic piston. The pumping unit 32 shown in FIG. 4 is fluidly connected with the piston chamber 201 via fluid channels 27, 28 provided in the wall of the stroke cylinder 20.

In the following, the side of the hydraulic piston facing the distal end of the downhole setting tool of FIG. 1 is referred to as the distal side 22*a*, and the side of the hydraulic piston facing the proximal end of the downhole setting tool is referred to as the proximal side 22*b*. From the hydraulic piston 22, a first piston rod 21 extends towards the distal end 1*b* of the downhole setting tool 1. At the end of the first piston rod opposite the hydraulic piston 22, a release device 10 is provided. In FIG. 1, the stroke cylinder may comprise a second chamber 202 and a second piston rod 23 extending from the hydraulic piston in a direction opposite to that of the first piston rod 21. The second piston rod 23 extends into the second chamber 202, which second chamber may have an internal pressure substantially equal to a pressure in the well. Hereby, the forces exerted on the first piston rod by the pressure in the well may be substantially balanced by the force exerted on the second piston rod by the pressure in the second chamber 202.

The release device 10 is adapted to couple the setting tool to the downhole object to be set as described in the following. The release device 10 of FIG. 2*a* extends between a proximal end 10*a* being coupled to the first piston rod 21 of the downhole setting tool 1 and a distal end 10*b* for being coupled to the downhole object, such as a running tool or a plug. The release device 10 comprises a base element 16 extending in a longitudinal direction and being releasably coupled to a connecting element 11 in order to be connected to the downhole object. The connecting element 11 is arranged in continuation of the base element 16 and thus constitutes the distal end 10*b* of the release device 10.

To be able to release the connecting element, the release device comprises an activatable release mechanism 60 comprising an activatable locking sleeve 14, a key element 13 encircling the activatable locking sleeve 14, and a release spring 15 forcing the locking sleeve 14 and the key element 13 in mutually opposite directions. The release mechanism 60 is retained in an annular bore 161 encircling a protruding centre part 12 of the base element 16, whereby in particular the locking sleeve 14 is movable in the longitudinal direction of the release device 10 along the centre part 12. As shown in the FIG. 2*a*, the base element 16 is constructed from two cooperating parts, namely the centre part 12 and a base part 16*a* joined by a threaded connection 124. By the centre part 12 being constructed as an individual part, the parts of the release mechanism 60 may easily be put in place before assembling the base element 16.

Towards the distal end 10*b* of the release device 10, the centre part 12 comprises a flange 125 providing a stop, thereby restricting further longitudinal movement of the locking sleeve 14 and the key element 13. The key element 13 comprises a plurality of key fingers 131 comprising protrusions 132. The key fingers 131 are flexible in a radial inwards direction, and the protrusions 132 are adapted to latch onto a recess 111 in the connecting element 11. Further, when the locking sleeve 14 is in the position shown in FIGS. 2*a* and 2*b*, the key fingers 131 are prevented from radial inwards movement and the locking sleeve 14 is said to be in a locking position. By restricting the key fingers 131 from inwards radial movement and at the same time restricting the longitudinal movement of the locking element beyond the flange 125 of the centre part 12 of the base element 16, the connecting element 11 is releasably coupled to the base element 16.

Figure 2A:
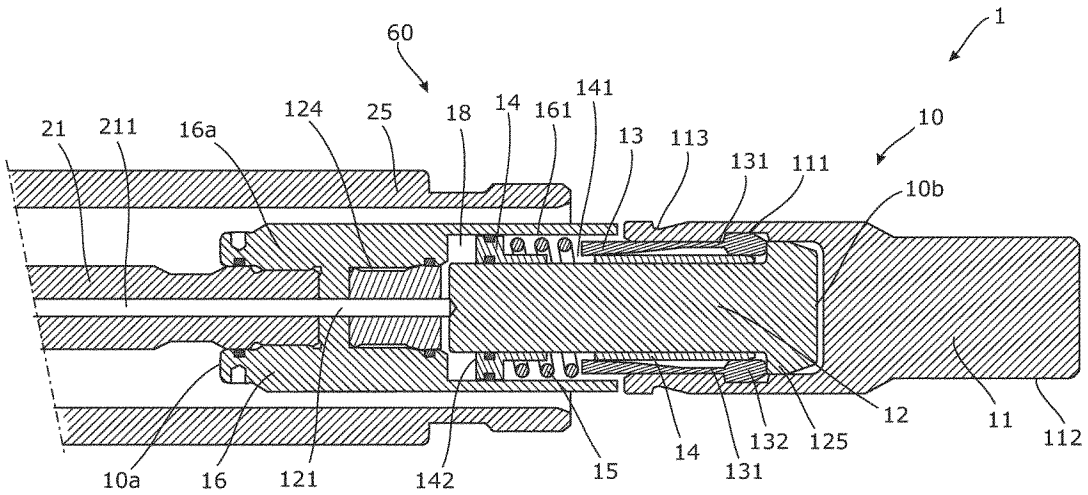
FIG. 2*a* shows a release device for releasably coupling a downhole object to a setting tool.
Figure 2B:
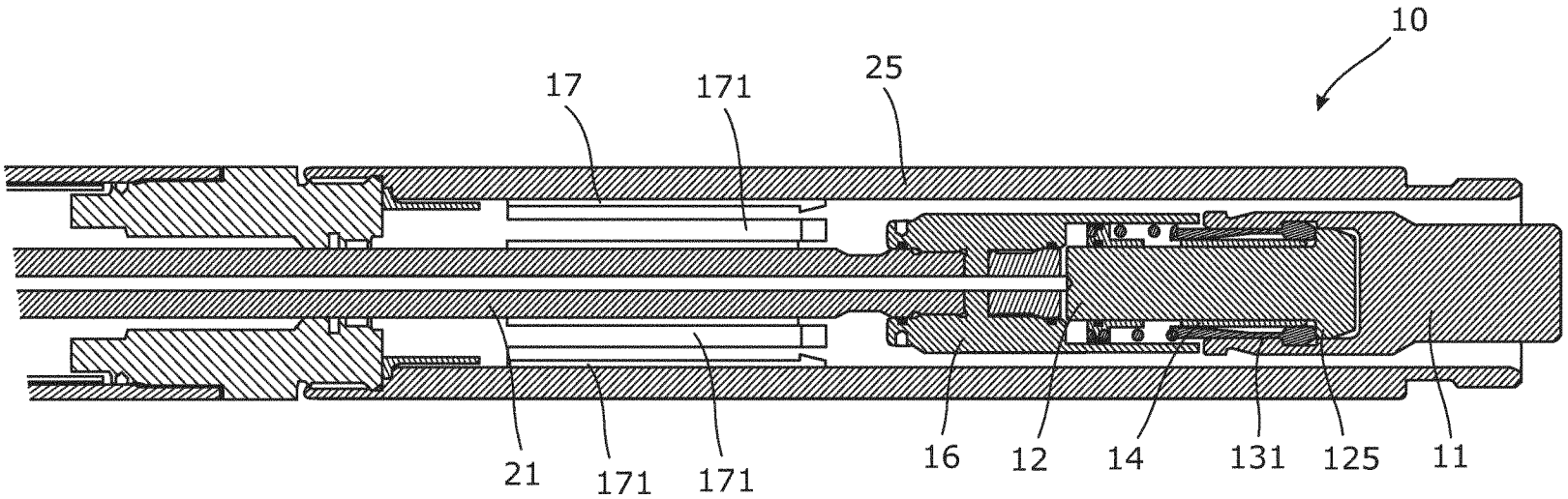
FIG. 2*b* shows the release device with the locking sleeve in a locking position.
Figure 2C:
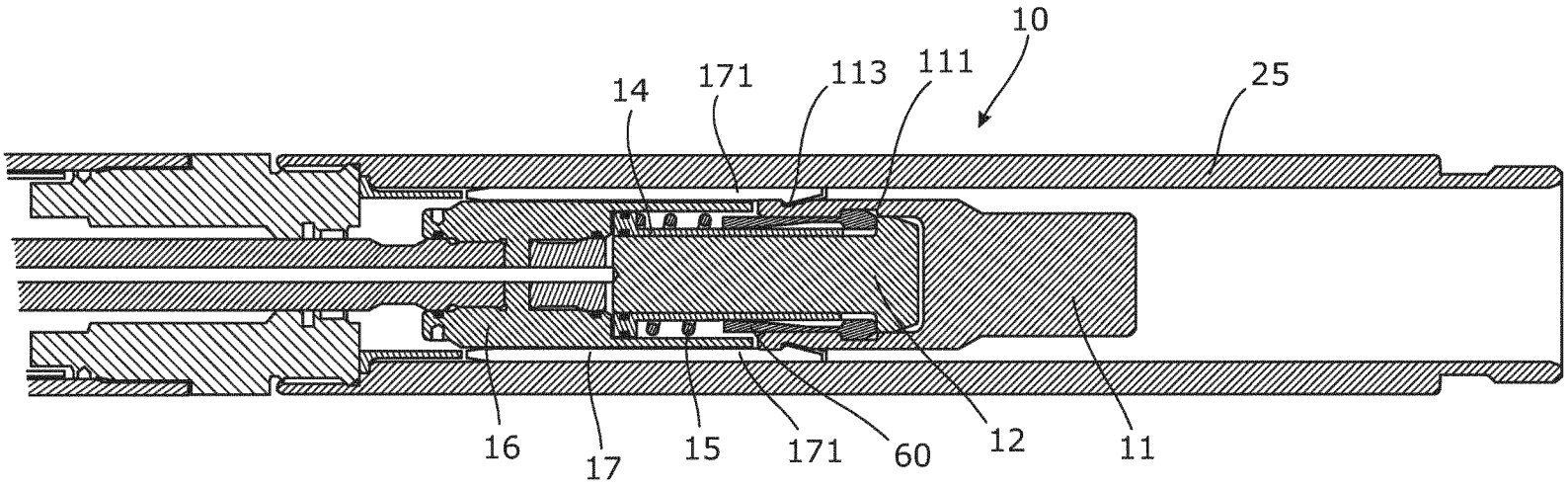
FIG. 2*c* shows the release device with the locking sleeve having been moved into a release position.

To release the connecting element 11 from the base element 16, the locking sleeve has to be moved into a release position, as shown in FIG. 2*c*. When the locking sleeve is in the release position, the key fingers 131 may be biased radially inwards by applying a pulling force to the connecting element 11.

FIG. 4 shows the downhole setting tool 1 inserted into a wellbore 70 with the object 80 to be set connected with the release device 10. Referring again to FIG. 1 and the enlarged view of part of the release device shown in FIG. 2*a*, the locking sleeve 14 is in the locking position, whereby the connecting element 11 is locked to the base element 16 of the release device 10. To set an object, such as a plug, a running tool is often provided between the release device and the plug. In that case, the release device is connected to the running tool and thus indirectly to the plug. To set the object, the release device 10 is pulled in the upstroke direction by injecting a hydraulic fluid into the piston chamber 201 on the distal side 22*a* of the hydraulic piston 22, whereby the hydraulic piston moves in the upstroke direction. Hydraulic fluid is supplied to the piston chamber 201 on the distal side 22*a* of the hydraulic piston 22 through the fluid channel 28 provided in the wall of the stroke cylinder 20. The hydraulic fluid entering the piston chamber on the distal side of the hydraulic piston will also enter a fluid channel 211 provided in the first piston rod 21. The fluid channel 211 is in fluid communication with the release devise 10 and supplies hydraulic fluid to the fluid channel 121 in the base element 16. The fluid channel 121 is in fluid communication with the expandable space 18, and the hydraulic fluid supplied under pressure to the expandable space will thus force the locking sleeve in a direction towards the distal end of the release device, thereby compressing the release spring. Moving the locking sleeve towards the distal end maintains the locking sleeve in a locking position as the key fingers 131 continue to be restricted from inwards radial movement.

Figure 3A:
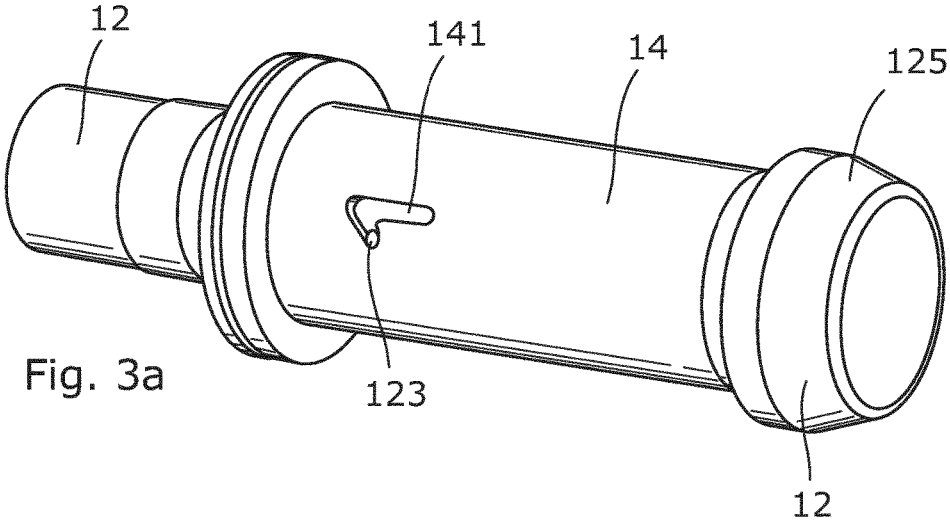
FIG. 3*a* shows the position of the pin in the guide slot before the locking sleeve is activated.
Figure 3B:
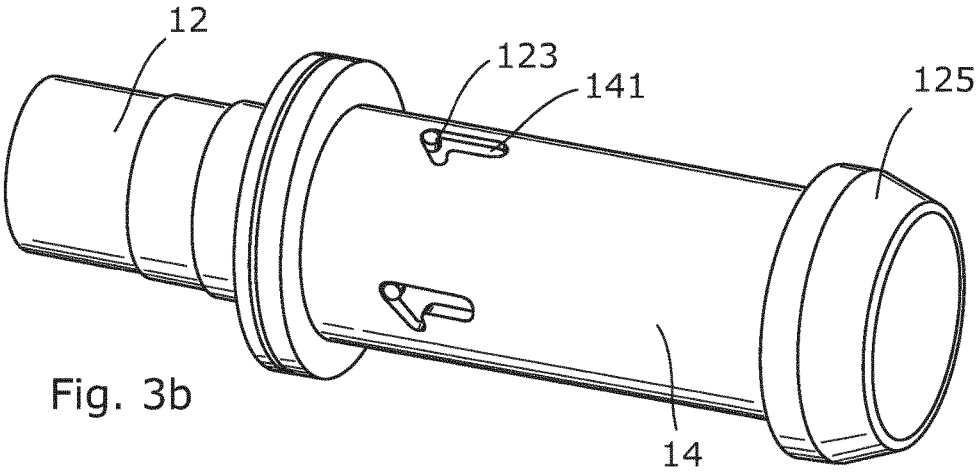
FIG. 3*b* shows the position of the pin in the guide slot when the locking sleeve is activated and in a locking position.
Figure 3C:
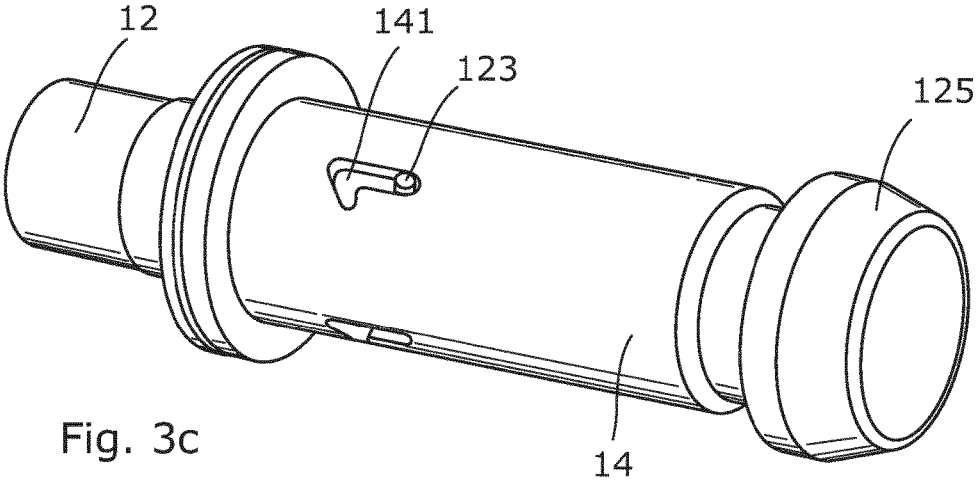
FIG. 3*c* shows the position of the pin in the guide slot when the locking sleeve is in the release position.

In FIGS. 3*a* and 3*b*, a guide slot 141 provided in the locking sleeve and a pin 123 extending radially from the base element are shown. The pin 123 extends into the guide slot 141 and cooperates with the guide slot by following the path of the slot. When the locking sleeve is moved towards the distal end of the release device by the hydraulic fluid, the locking sleeve is rotated slightly due to the cooperation between the pin 123 and the j-formed guide slot 141, also referred to as a j-slot. Thus, the pin moves in the slot from one end of the slot, as shown in FIG. 3*a*, to an intermediate position, as shown in FIG. 3*b*. By this movement of the locking sleeve 14, the locking sleeve is said to be activated as the pin 123 extending into the guide slot 141 no longer restricts movement of the locking sleeve 14 towards the proximal end of the release device due to the force of the release spring and if the hydraulic pressure on the locking sleeve is released. In the position of the locking sleeve 14, shown in FIG. 3*a*, the locking sleeve 14 cannot move towards the proximal end 10*a* of the release device 10 due to the pin 123, whereas in the position shown in FIG. 3*b*, the locking sleeve 14 is no longer restricted from movement in this direction. When the release spring 15 forces the locking sleeve 14 towards the proximal end 10*a* of the release device 10, the pin 123 moves to the other end of the guide slot 141, as shown in FIG. 3*c* and as will be further described in the following. The functionality of the cooperating pin and guide slot may be replaced by a shear pin preventing longitudinal movement of the locking sleeve prior to activation. Using a shear pin, activation of the locking sleeve by supply of hydraulic fluid to the release device would result in the shear pin breaking, whereby the locking sleeve may move freely.

It is known by the skilled person that objects to be set in a well, such as a plug, may be of varying designs applying numerous different anchoring mechanisms. However, common to most objects to be set is that following the setting of the object, a part of the object is separated from the part of the object comprising the actual anchoring mechanism. The separated part of the object may thus be retrieved from the well.

When setting the object in the well, the release device 10 shown in FIG. 2*b* is pulled in the upstroke direction, as explained above. As the running tool or the object being set is threadedly connected to an outer thread 112 of the connecting element 11, part of the running tool or the object being set abuts the spacer element 25, whereby the anchoring mechanism of the object to be set is activated and the object sets in the well, as it is readily understood by the skilled person. Further, setting the object separates the running tool and/or a part of the object from the part of the object comprising the anchoring mechanism. Thus, if the setting process proceeds as planned, it will be possible to move the hydraulic piston of the downhole setting tool all the way to the upstroke position. When the hydraulic piston 22 of FIG. 1 is in the upstroke position, the release device 10 is moved to an extreme position inside the spacer element 25 opposite the opening, as shown in FIG. 2*c*. Inside this part of the spacer element 25, a locking element 17 comprising a plurality of flexible locking fingers 171 is provided. The flexible locking fingers 171 are displaceable in a radial outwards direction. When the release device 10 is moved to the above-mentioned extreme position inside the spacer element 25, the flexible locking fingers 171 are biased in an outwards radial direction, whereby the locking element 17 engages the release device 10.

As shown in FIG. 2*c*, the flexible locking fingers 171 engage a recess 113 in an outer surface of the connecting element 11, thereby fixating the release device. The connection element 11 thus comprises two to separate fishing necks constituted by the inward facing recess 111 arranged internally in the connection element and the outward facing recess 113 provided in the outer surface of the connecting element 11, as described above. Each of the inward facing recess 111 and outward facing recess 113 can be used for fishing the connecting element and thus the downhole object.

If setting the object does not separate the running tool and/or a part of the object from the part of the object comprising the anchoring mechanism, and the anchoring mechanism is partly activated obstructing retrieval of the downhole setting tool, the release device may be activated to disengage the downhole setting tool from the running tool and/or object, thus leaving a part of the release device, i.e. the connecting element, in the well.

To activate the release device shown in FIG. 1, the supply of hydraulic fluid to the piston chamber 201, and thus to the release device, is terminated. When the hydraulic fluid no longer exerts a force on the locking sleeve 14 as shown in FIG. 2*a*, the locking sleeve 14 is forced towards the proximal end 10*a* of the release device 10 into the release position by the release spring 15. In the release position, the locking sleeve 14 no longer prevents the key fingers 131 from radial inwards movement, as shown in FIG. 2*c*. Subsequently, application of a pulling force to the connecting element would result in the connecting element being disengaged from the base element. The pulling force may be required by pulling in the entire tool string comprising the downhole setting tool, as described below. Disengagement of the connecting element may require a substantial pulling force in the magnitude of 100-300 kg to prevent unintentional disengagement. When the connecting element has been disengaged, the remainder of the downhole setting tool is released from the running tool and/or the object being set and the downhole setting tool may be retrieved from the well.

In a similar manner, the supply of hydraulic fluid to the release device may be terminated when the locking element 17 engages the connecting element and thereby fixates the release device 10. As the locking element 17 secures the connecting element 11, it is not necessary to keep the locking sleeve 14 in the locking position to prevent disengagement of the connecting element 11 from the base element 16. As described above, termination of the supply of hydraulic fluid results in the locking sleeve being forced into the release position by the release spring 15, whereby the release mechanism 60 no longer retains the connecting element 11.

FIG. 4 shows the downhole setting tool 1 inserted into a casing 160 in a wellbore 70. In addition to the above, the shown downhole setting tool 1 comprises a pumping unit 32 for pumping hydraulic fluid into the stroke cylinder 20 on respective sides of the hydraulic piston, an anchoring section 30 for anchoring the downhole setting tool 1 in the wellbore 70, and a driving unit 40 for driving the entire downhole setting tool 1 forward in inclining sections of a wellbore 70. Depending on the specific requirements of the setting operation, the downhole tool may be provided with or without the driving unit 40 and/or the anchoring section 30.

Figure 5:
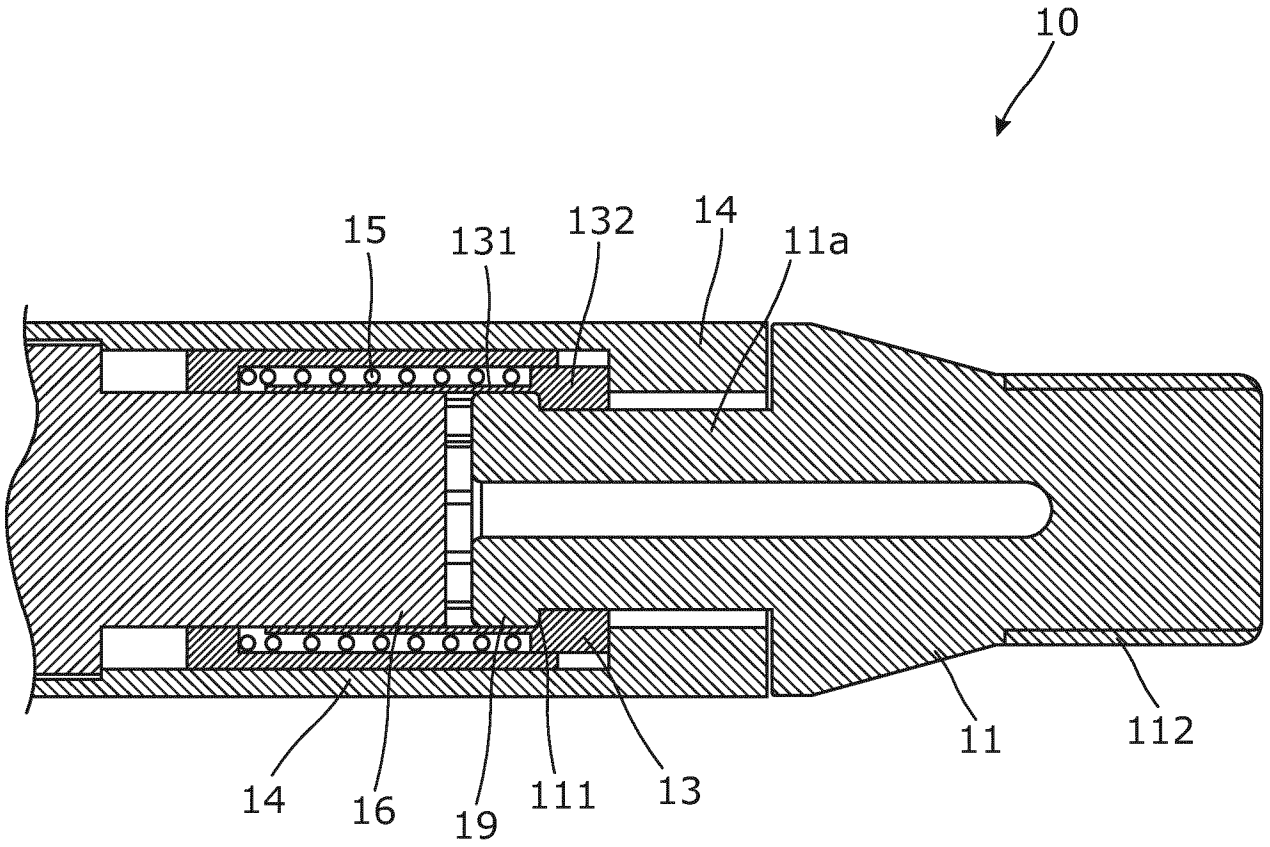
FIG. 5 shows another embodiment of the release device.

In FIG. 5, the connecting the connecting element 11 has a centre part 11*a* having a flange. The protrusions 132 of the key fingers 131 of the key element 13 engage a recess 111 in the connecting element 11 provided by the flange 19. The locking sleeve 14 is arranged in the annular cavity in the base element 16, and the spring 15 is arranged between locking sleeve and the key fingers, and the release device 10 thereby restricts further longitudinal movement of the locking sleeve 14 and the key element 13. The key fingers 131 are flexible in a radial inwards direction, and the protrusions 132 are adapted to latch onto a recess 111 in the connecting element 11. Further, when the locking sleeve 14 is in the position shown in FIG. 5, the key fingers 131 are prevented from radial inwards movement, and the locking sleeve 14 is said to be in the locking position. By restricting the key fingers 131 from inwards radial movement and at the same time restricting the longitudinal movement of the locking element, the connecting element 11 is releasably coupled to the base element 16. In the event that the release device 10 intentionally or unintentionally drops or releases from the downhole object, the flange 19 and the recess 111 can be used as a fishing neck for retrieving the downhole object.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A release device for releasably connecting a downhole object to a setting tool, the release device extending between a proximal end adapted to be coupled to the setting tool and a distal end adapted to be coupled to the downhole object, the release device comprising:

a base element extending in a longitudinal direction, characterised in that the release device further comprises:

a connecting element arranged in continuation of the base element, the connecting element constituting the distal end of the release device and being adapted to be coupled to the downhole object, wherein the connecting element is releasably coupled to the base element by an activatable release mechanism comprising an activatable locking sleeve slidable in the longitudinal direction and a key element having a plurality of key fingers to latch onto the connecting element, the key fingers being flexible in an inwards radial direction to allow release of the connecting element from the base element, the inwards flexibility of the key fingers being controlled by the position of the locking sleeve, and wherein the release mechanism further comprises a release spring forcing the locking sleeve and the key element in mutually opposite directions, and wherein the activatable locking sleeve is hydraulically activated by injection of a hydraulic fluid into an expandable space, defined, at least partly, by a piston face of the locking sleeve, whereby hydraulic fluid supplied under pressure to the expandable space forces the locking sleeve in a direction towards the distal end of the release device and into a locking position, thereby compressing the release spring and preventing the key fingers from flexing in the inwards radial direction, and wherein when the hydraulic fluid no longer exerts a force on the locking sleeve, the release spring forces the locking sleeve towards the proximal end and into a release position, thereby de-activating the release mechanism and allowing the key fingers to move in the inwards radial direction and therefore separation of the connecting element from the base element upon application of an upwards pulling force.

2. A release device according to claim 1, wherein the base element comprises a fluid channel for supplying the hydraulic fluid to the expandable space.

3. A release device according to claim 2, wherein the activatable locking sleeve is slidably arranged around at least a part of the base element, and wherein the expandable space is at least partly defined by the base element and the piston face of the locking sleeve.

4. A release device according to claim 1, wherein the base element comprises an annular bore encircling a protruding centre part of the base element extending in the longitudinal direction, and the activatable locking sleeve is slidably arranged around the protruding centre part and slidably arranged between the locking position, wherein the locking sleeve prevents inwards radial movement of the key fingers, and the release position, wherein the key fingers are inwardly flexible.

5. A release device according to claim 4, wherein part of the activatable locking sleeve encloses part of the annular bore, thereby providing the expandable space adapted to be expanded by supply of the hydraulic fluid via the fluid channel provided in the base element, whereby the locking sleeve is forced in the longitudinal direction towards the distal end of the release device and thereby activated, and wherein a release spring is adapted to force the activated locking sleeve in an opposite direction into the release position when the supply of hydraulic fluid is terminated.

6. A release device according to claim 1, wherein the base element comprises a radial protruding pin preventing the release spring from forcing the locking sleeve in the direction away from the distal end of the release device and into the release position before the activatable locking sleeve has been activated.

7. A release device according to claim 6, wherein the locking sleeve comprises a guide slot cooperating with the pin, whereby the locking sleeve is rotated when the locking sleeve is forced towards the distal end of the release device by supply of the hydraulic fluid to the expandable space.

8. A release device according to claim 1, wherein the connecting element comprises a first recess provided in an outer surface thereof for providing a fishing neck.

9. A release device according to claim 1, wherein the connecting element comprises an inwards facing recess arranged internally in the connection element, thereby constituting a fishing neck.

10. A downhole setting tool for setting an object in a wellbore, the downhole setting tool extending between a proximal end adapted to be coupled to a tool string and a distal end facing the object to be set, the downhole setting tool comprising:

a stroke cylinder defining a piston chamber, a hydraulic piston being slidably arranged in the piston chamber for providing a force in the longitudinal direction by supply of a hydraulic fluid to the piston chamber, and a first piston rod extending from the hydraulic piston, wherein the downhole setting tool comprises the release device according to claim 1 for releasably connecting the piston rod with a downhole object.

11. A downhole setting tool according to claim 10, further comprising a hydraulic system comprising a pump unit driven by an electrical motor, the pump unit being adapted to supply a hydraulic fluid to the piston chamber and to the expandable space of the release device, whereby supply of the hydraulic fluid to the expandable space activates the locking sleeve.

12. A downhole setting tool according to claim 10, wherein the first piston rod comprises a fluid channel for supplying the hydraulic fluid to the release device.

13. A downhole setting tool according to claim 12, wherein the fluid channel of the first piston rod is in fluid communication with the piston chamber and the fluid channel of the base element, whereby hydraulic fluid may be supplied to the release device via the fluid channel of the first piston rod.

14. A downhole setting tool according to claim 10, wherein the downhole setting tool further comprises the locking element comprising a plurality of locking fingers flexible in a radial direction and adapted to latch onto the recess in the outer surface of the connecting element of the release device when the hydraulic piston is pushed all the way towards the proximal end of the downhole setting tool.

15. A downhole setting tool according to claim 10, further comprising a spacer element extending from the stroke cylinder towards the distal end of the downhole setting tool.

16. A downhole setting tool according to claim 10, further comprising a driving unit for driving the entire downhole setting tool forward in a wellbore.

17. A method for disconnecting a downhole object from a downhole setting tool according to claim 10, the method comprising:

supplying a hydraulic fluid to the release device, whereby the locking sleeve is forced towards the distal end of the release device while being rotated about a longitudinal axis, terminating the supply of hydraulic fluid to the release device, whereby the release spring forces the locking sleeve into a release position, allowing inwards radial movement of the key fingers, and applying a pulling force to the release device by moving the hydraulic piston or pulling in the entire downhole setting tool, whereby the key fingers are forced out of engagement with the connecting element.

* * * * *